US006742491B1

(12) United States Patent
Ghelfi et al.

(10) Patent No.: US 6,742,491 B1
(45) Date of Patent: Jun. 1, 2004

(54) ENGINE LUBRICATION SYSTEM

(75) Inventors: Giuseppe Ghelfi, Turin (IT); Paolo Mion, Turin (IT); Stefano Albanello, Chatillon (IT); Maurizio Borio, Turin (IT)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/322,091

(22) Filed: Dec. 17, 2002

(51) Int. Cl.[7] ..... F01C 1/02
(52) U.S. Cl. ..... 123/196 R
(58) Field of Search ..... 123/196 R; 184/6.18

(56) References Cited

U.S. PATENT DOCUMENTS

| | | | | | |
|---|---|---|---|---|---|
| 863,153 | A | * | 8/1907 | Coffman | 384/369 |
| 1,822,573 | A | * | 9/1931 | Gerald et al. | 440/56 |
| 2,630,881 | A | | 3/1953 | Bosma | 184/6 |
| 3,848,702 | A | | 11/1974 | Bergman | 184/6.3 |
| 4,040,309 | A | | 8/1977 | Wood et al. | 74/665 T |
| 4,156,416 | A | * | 5/1979 | Weisgerber et al. | 123/196 R |
| 4,638,683 | A | | 1/1987 | Ogawa et al. | 74/567 |
| 4,648,363 | A | * | 3/1987 | Kronich | 123/196 R |
| 4,662,328 | A | * | 5/1987 | Kronich | 123/198 C |
| 4,875,827 | A | | 10/1989 | Gschwender et al. | 415/111 |
| 4,896,634 | A | | 1/1990 | Kronich | 123/90.34 |
| 4,911,119 | A | * | 3/1990 | Ohno et al. | 123/196 W |
| 4,928,651 | A | | 5/1990 | Kronich | 123/196 AB |
| 4,949,683 | A | | 8/1990 | Swars | 123/90.34 |
| 4,977,793 | A | | 12/1990 | Husted | 74/567 |
| 5,041,253 | A | | 8/1991 | Husted | 264/251 |
| 5,067,369 | A | | 11/1991 | Taniguchi | 74/567 |
| 5,072,809 | A | | 12/1991 | Shibata | 184/6.13 |
| 5,215,164 | A | | 6/1993 | Shibata | 184/6.13 |
| 5,273,007 | A | | 12/1993 | Ampferer | 123/90.34 |
| 5,317,999 | A | | 6/1994 | Kern et al. | 123/182.1 |
| 5,320,795 | A | | 6/1994 | Mitchell et al. | 264/318 |
| 5,341,901 | A | | 8/1994 | Mueller et al. | 184/6.12 |
| 5,497,679 | A | | 3/1996 | Mitchell et al. | 74/567 |
| 5,497,735 | A | | 3/1996 | Kern et al. | 123/90.6 |
| 5,797,180 | A | | 8/1998 | Buchholz | 29/888.1 |
| 5,852,951 | A | | 12/1998 | Santi | 74/443 |
| 5,947,070 | A | | 9/1999 | Immel et al. | 123/90.6 |
| 6,014,808 | A | | 1/2000 | Santi | 29/893.37 |
| 6,064,027 | A | | 5/2000 | Santi | 219/69.12 |
| 6,077,063 | A | | 6/2000 | Santi | 425/116 |
| 6,295,959 | B1 | | 10/2001 | Molina et al. | 123/90.31 |
| 6,363,904 | B1 | | 4/2002 | Kurihara et al. | 123/196 R |
| 6,494,696 | B2 | * | 12/2002 | Terai et al. | 418/55.6 |

* cited by examiner

*Primary Examiner*—Henry C. Yuen
*Assistant Examiner*—Jason Benton
(74) *Attorney, Agent, or Firm*—Baker & Daniels

(57) ABSTRACT

The present invention provides a lubrication system for small internal combustion engines. In a first aspect, a helical oil pump includes a helical insert which is disposed within a bore in the engine camshaft and is rotationally fixed with respect to the crankcase. During running of the engine, rotation of the camshaft draws oil from the oil sump upwardly through the bore in the camshaft and around the helical insert to provide lubrication oil directly to the upper camshaft bearing and to the upper crankshaft bearing. In another aspect, an impeller oil pump includes a pump chamber defined between the camshaft gear and a pump body which is rotationally fixed with respect to the crankcase and in communication with the oil sump. An impeller assembly mounted on the camshaft is disposed within the pump chamber, and draws oil from the oil sump into the pump chamber. The oil is forced outwardly of the pump chamber through an opening in the camshaft gear in the form of a stream of pressurized oil which is directed toward different locations within the crankcase as the camshaft gear rotates with the camshaft.

20 Claims, 9 Drawing Sheets

ENGINE LUBRICATION SYSTEM

BACKGROUND OF THE INVENTION

1. Field of the Invention

The present invention relates to lubrication systems for small internal combustion engines of the type used with lawnmowers, lawn and garden tractors, other small implements, or sport vehicles.

2. Description of the Related Art

Small internal combustion engines typically include a crankcase with an oil sump containing an amount of oil which is conveyed to various lubrication points within the engine to lubricate the moving parts within the engine.

One known lubrication arrangement employs an oil dipper or slinger which is mounted to the end of the connecting rod or to the engine crankshaft which, during the rapid rotation of the engine crankshaft during running of the engine, contacts the oil in the oil sump to agitate and splash the oil into a mist within the engine crankcase. The oil mist contacts and lubricates the various moving parts within the crankcase. Additionally, pressure pulses within the crankcase which are created by the reciprocation of one or more of the engine pistons may be employed to convey the oil mist from the crankcase to other portions of the engine which include moving parts, such as the cylinder head. The foregoing lubrication arrangement is typically referred to as "splash lubrication", and usually is most useful in small, single cylinder engines.

A disadvantage of splash lubrication is that same does not provide pressurized, liquid oil directly to the various lubrication points within the engine, such as shaft bearings. Additionally, splash lubrication systems can be difficult to design which are effective for use in twin cylinder engines and for some vertical crankshaft engines.

In another lubrication arrangement, a gerotor pump, or another suitable type of oil pump, is driven from the crankshaft or camshaft within the engine crankcase. The oil pump is operable to draw oil from the oil sump and force the oil under pressure through passages within the crankshaft and/or camshaft or other oil galleries in the engine housing in order to convey the oil to specific lubrication points within the engine, such as shaft bearings or contact points within the valve train.

A disadvantage with existing lubrications systems which include gerotor or other types of oil pumps is that same typically include a number of moving parts, may be difficult to manufacture, and may require the machining of numerous oil passages in the engine shafts and/or engine housing to convey the pressurized oil to the various lubrication points.

In another arrangement, often referring to as "dry sump" lubrication, the crankcase includes a minimal amount of oil, wherein most of the engine oil is stored in an oil reservoir which is separate from the crankcase. A lubrication pump is driven by the engine, and pumps oil from the oil reservoir through passages in the crankshaft and/or camshaft or other galleries in the engine housing to lubricate the moving parts of the engine. Thereafter, the oil drips back into the crankcase. A scavenge pump, also driven by the engine, pumps the oil within the crankcase back into the oil reservoir.

A disadvantage with dry sump lubrication systems is that same require two oil pumps and a separate oil reservoir, which increases the cost and complexity of such systems.

Additionally, other lubrication systems for small internal combustion engines may include various combinations of some or all of the components of the foregoing lubrication arrangements.

What is needed is a lubrication system for small internal combustion engines which is an improvement over the foregoing.

SUMMARY OF THE INVENTION

The present invention provides a lubrication system for small internal combustion engines. In a first aspect of the present invention, a helical oil pump includes a helical insert disposed within a bore in the engine camshaft. The camshaft is rotatably driven from the crankshaft, while the helical insert is rotationally fixed with respect to the crankcase. The lower ends of the camshaft and the helical insert are in communication with the oil sump of the crankcase and, during running of the engine, rotation of the camshaft draws oil from the oil sump upwardly through the bore in the camshaft and around the helical insert to provide lubrication oil directly to the upper camshaft bearing and thence to the upper crankshaft bearing through a passage in the crankcase.

In another aspect of the present invention, an impeller oil pump includes a pump chamber defined between the camshaft gear and a pump body which is rotationally fixed with respect to the crankcase and in communication with the oil sump. An impeller assembly mounted on the camshaft is disposed within the pump chamber such that, upon rotation of the camshaft, the impeller assembly draws oil from the oil sump into the pump chamber. The oil is forced outwardly of the pump chamber through an opening in the camshaft gear in the form of a stream of pressurized oil which is directed toward different locations within the crankcase as the camshaft gear rotates with the camshaft.

Advantageously, the helical oil pump of the present lubrication system provides pressurized lubrication oil directly to the upper camshaft bearing and to the upper crankshaft bearing to lubricate same. Additionally, the impeller oil pump supplies a stream of pressurized oil which is directed toward a plurality of locations within the crankcase as the cam gear rotates, thereby lubricating the crank pin, drive train components, and other moving parts within the crankcase with a stream of pressurized oil. Further, the oil pump is effective to circulate a large volume of oil continuously within the crankcase, such that the stream of pressurized oil which contacts the crankcase walls helps to cool the crankcase and reduce the operating temperature of the engine.

In one form thereof, the present invention provides an internal combustion engine, including a crankcase containing an oil sump therein; a crankshaft rotatably supported within the crankcase; a second shaft rotatably supported within the crankcase in timed driven relationship with the crankshaft, the second shaft disposed vertically and including a bore therethrough which communicates between upper and lower ends of the second shaft; and a helical insert disposed within the bore, the helical insert rotationally fixed with respect to the crankcase, the lower end of the second shaft and the helical insert in communication with the oil sump wherein rotation of the second shaft about the helical insert draws oil from the oil sump upwardly through the bore.

In another form thereof, the present invention provides an internal combustion engine, including a crankcase containing an oil sump therein; a shaft rotatably supported within the crankcase; a plate mounted on the shaft and rotatable therewith, the plate having at least one opening therethrough; a pump body fixed with respect to the crankcase and in fluid communication with the oil sump, the pump body and the plate defining a pump chamber therebetween;

and an pump assembly disposed within the pump chamber and mounted on the shaft for rotation therewith; whereby rotation of the shaft and the pump assembly draws oil from the oil sump into the pump chamber and forces oil outwardly of the pump chamber through the opening in the plate.

In a further form thereof, the present invention provides an internal combustion engine, including a crankcase containing an oil sump therein; a shaft rotatably supported within the crankcase, the shaft including a bore therethrough which communicates between upper and lower ends of the shaft; a helical insert disposed within the bore, the helical insert rotationally fixed with respect to the crankcase, the lower end of the second shaft and the helical insert in communication with the oil sump; a plate mounted on the shaft and rotatable therewith, the plate having at least one opening therethrough; a pump body fixed with respect to the crankcase and in fluid communication with the oil sump, the pump body and the plate defining a pump chamber therebetween; and a pump assembly disposed within the pump chamber and mounted on the shaft for rotation therewith; whereby rotation of the shaft and the pump assembly about the helical insert draws oil from the oil sump upwardly through the bore, and draws oil from the oil sump into the pump chamber and forces oil outwardly of the pump chamber through the opening in the plate.

In a further form thereof, the present invention provides a method of cooling an internal combustion engine, including the steps of rotating a shaft within the engine crankcase which includes a plate and an impeller mounted thereon, the impeller disposed within a pump housing at least partially defined by the plate; drawing oil from an oil sump within the engine crankcase into the pump housing through an inlet opening submerged within the oil sump; pressurizing the oil within the pump housing; directing the oil outwardly of the pump housing through at least one opening in the plate, in the form of a pressurized oil stream which rotates with the plate to contact a plurality of locations within the crankcase; transferring heat from the crankcase to the oil upon contact of the stream with the plurality of locations within the crankcase; and allowing the oil to drain from the plurality of locations within the crankcase into the oil sump.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrates preferred embodiments of the invention, and such exemplifications are not to be construed as limiting the scope of the invention any manner.

DETAILED DESCRIPTION

Figure 1:
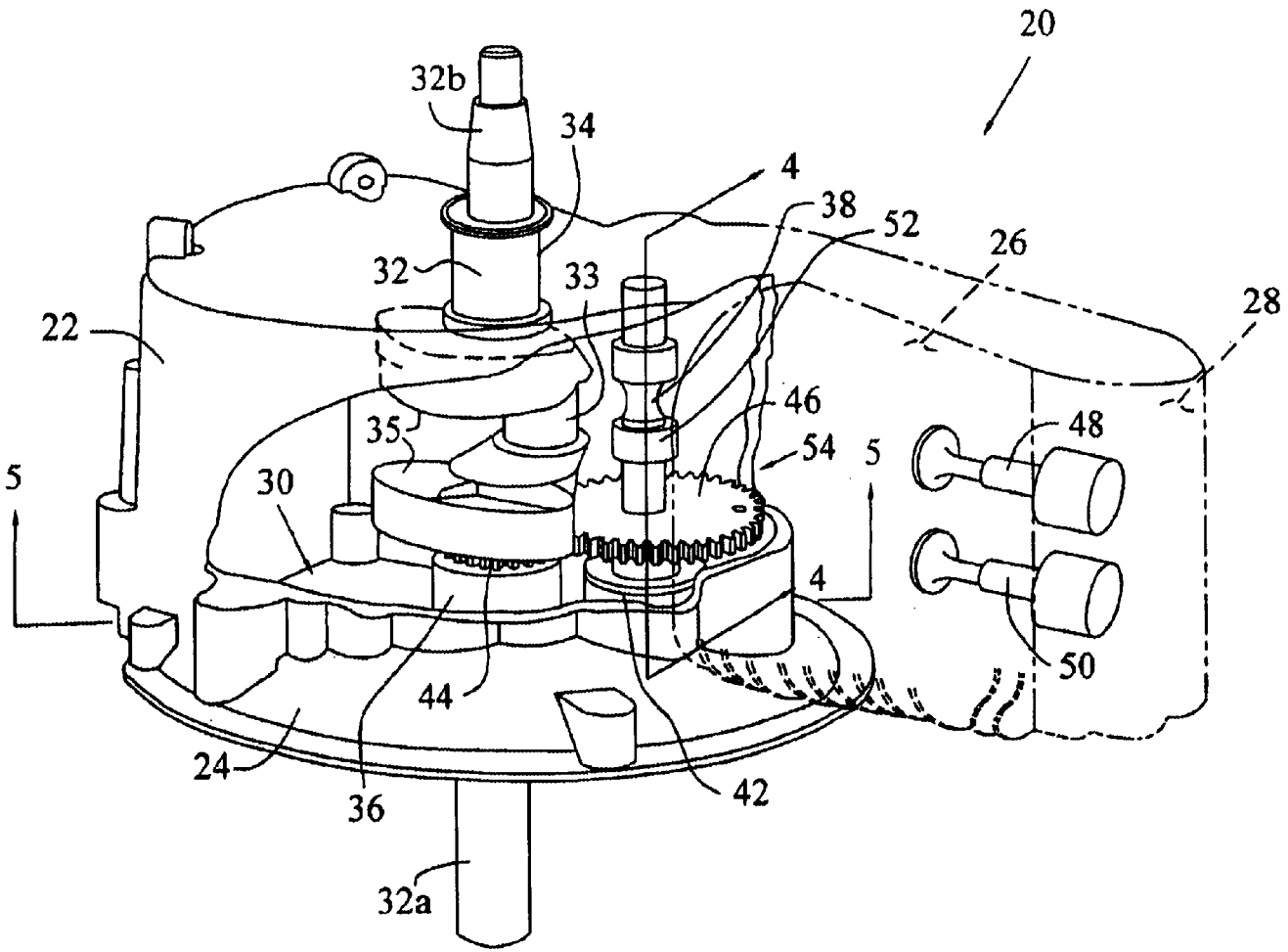
FIG. 1 is a perspective view of a small internal combustion engine, the crankcase of which is partially cut away to show the interior of the crankcase, including the crankshaft and the camshaft.
Figure 5:
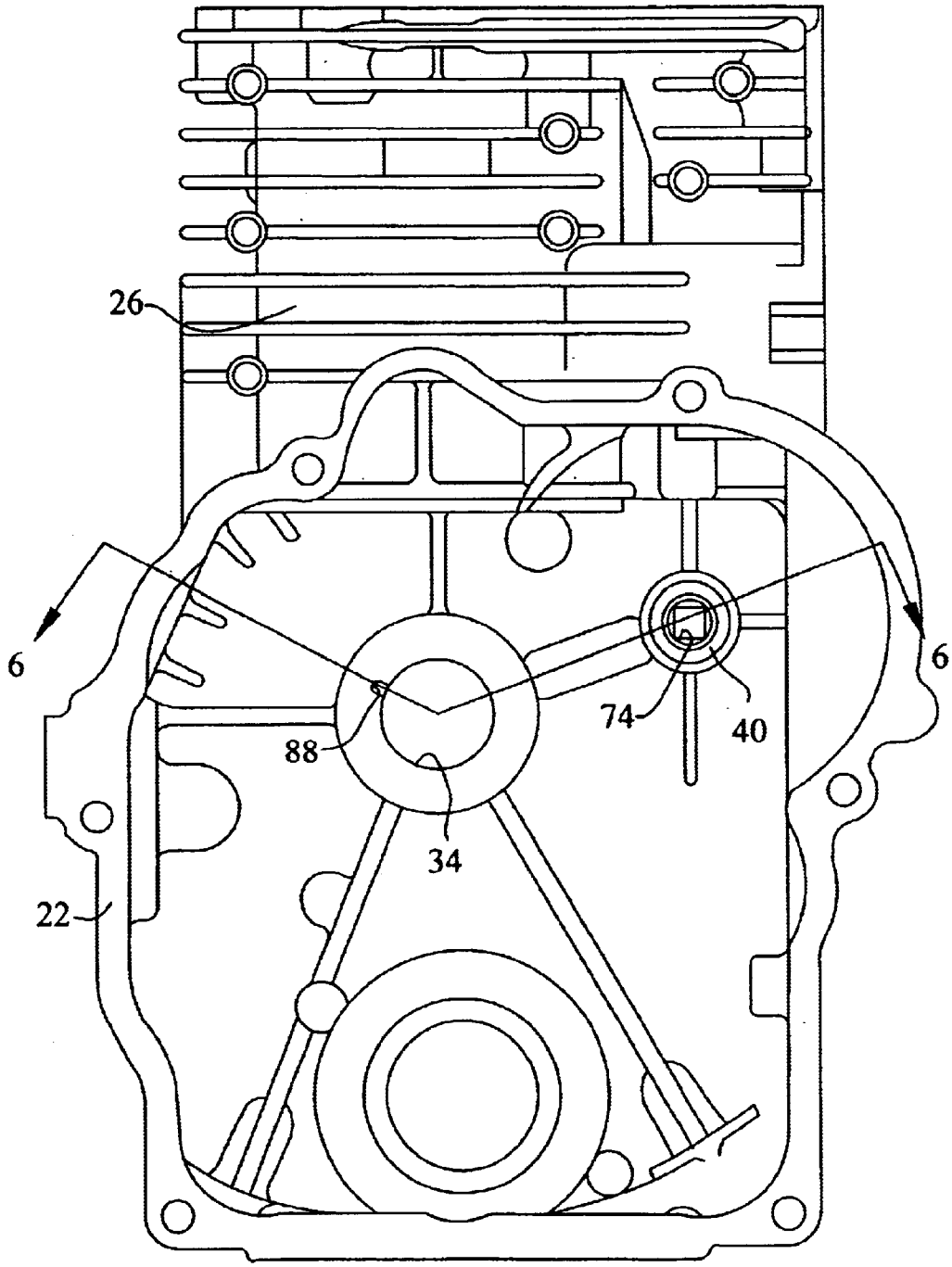
FIG. 5 is a bottom view of the crankcase and cylinder of the engine of FIG. 1, looking upwardly along line 5—5 of FIG. 1, showing the upper crankshaft and camshaft bearings.

Referring to FIG. 1, internal combustion engine 20 is shown, which includes a lubrication system according to the present invention, the details and operation of which are described below. Generally, engine 20 includes an engine housing with crankcase 22, mounting flange 24, cylinder block 26, and cylinder head 28. As shown in FIGS. 1 and 5, crankcase 22 is integrally formed with cylinder block 26, with mounting flange 24 attached to crankcase 22 and cylinder head 28 attached to cylinder block 26 in a suitable manner; however, other arrangements for configuring the housing of engine 20 may be used.

Mounting flange 24 is typically attached to the deck of a lawnmower, the chassis of a lawn and garden tractor, or to another implement. Mounting flange 24 contains oil sump 30 therein, including an amount of oil for lubricating the various moving parts within engine 20. Crankshaft 32 is shown vertically disposed within crankcase 22, and is journalled in upper and lower crankshaft bearings 34 and 36 carried by crankcase 22 and mounting flange 24, respectively. Crankshaft 32 includes power take-off ("PTO") end 32*a* extending externally of mounting flange 24, and an opposite end 32*b* extending externally of crankcase 22 for attachment thereto of a flywheel/blower (not shown) and/or a recoil starter assembly (not shown), for example. Crankshaft 32 additionally includes an eccentric crank pin 33 disposed between throws 35. A piston (not shown) is operatively coupled to crank pin 33 via a connecting rod (not shown) in a conventional manner.

Additionally, camshaft 38 is supported for rotation within crankcase 22 by upper and lower camshaft bearings 40 (FIGS. 5 and 6) and 42, carried by crankcase 22 and mounting flange 24, respectively. Drive gear 44 is secured to crankshaft 22, and engages camshaft gear 46 mounted to camshaft 38 such that camshaft 38 is driven by crankshaft 22 in timed relation. For example, in a four stroke engine, drive gear 44 and camshaft gear 46 are sized such that drive gear 44 drives camshaft gear 46 at one half crankshaft speed. Intake and exhaust valves 48 and 50 are disposed within cylinder block 26 and/or cylinder head 28 of engine 20 and are actuated via a suitable drive train coupling camshaft 38 to valves 48 and 50. For example, in an overhead valve ("OHV") engine, lobes 52 on camshaft 38 may actuate push rods (not shown) which in turn actuate rocker arms (not shown) within cylinder head 28 to open and close intake and exhaust valves 48 and 50. Alternatively, in an overhead cam ("OHC") engine, "camshaft" 38 may be drivingly connected to a separate camshaft (not shown) disposed within cylinder head 28 via a belt or chain drive, which camshaft engages intake and exhaust valves 48 and 50 to open and close same. One such OHC engine is disclosed in U.S. Pat. No. 6,295,959, assigned to the assignee of the present invention, the disclosure of which is expressly incorporated herein by reference. In a side valve or L-head engine, lobes 52 of camshaft 38 may directly actuate intake and exhaust valves within cylinder block 26, or may indirectly actuate such valves through lifters (not shown). As will be apparent from the discussion below, the lubrication system of the present invention may be used in any number of internal combustion engines which may include various drive train configurations.

Figure 2:
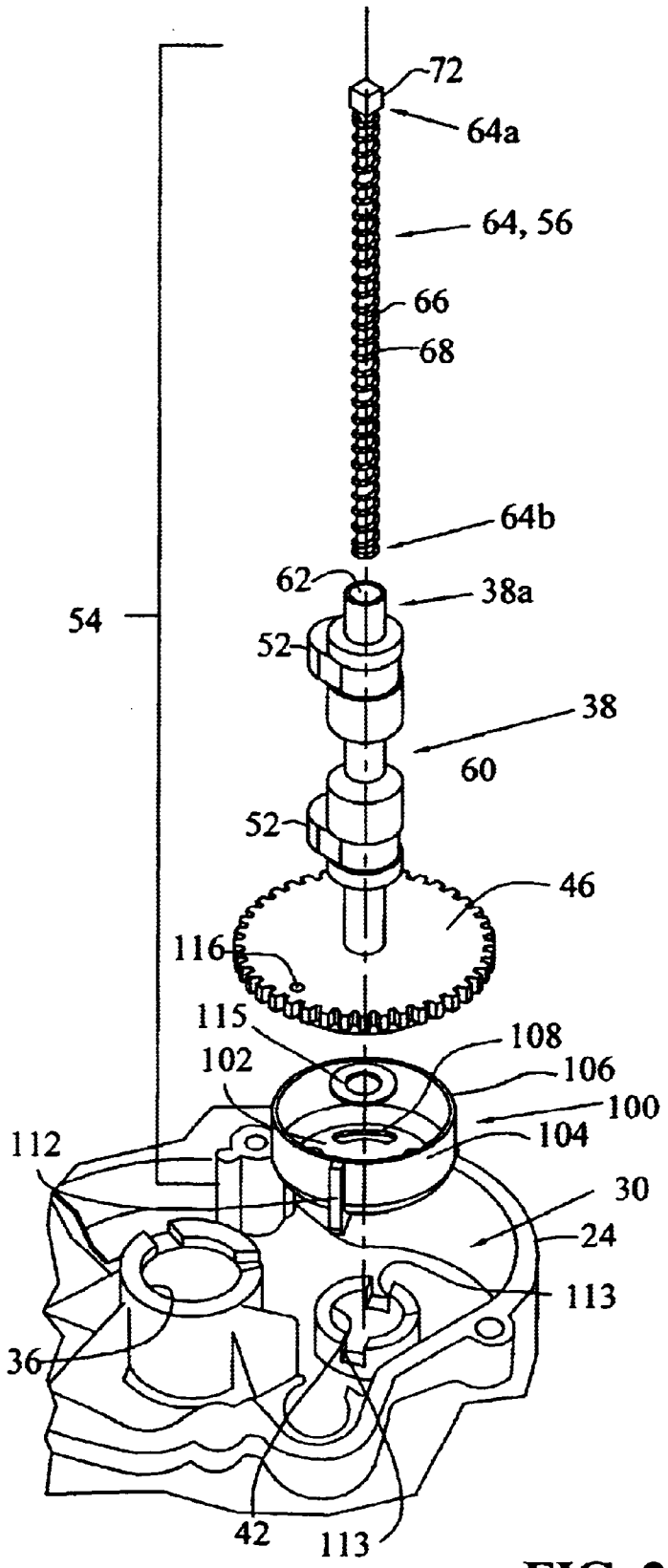
FIG. 2 is a perspective fragmentary view of a lower portion of the crankcase, and an exploded view of the various components of the lubrication assembly according to the present invention, looking downwardly along the components of the lubrication assembly.
Figure 3:
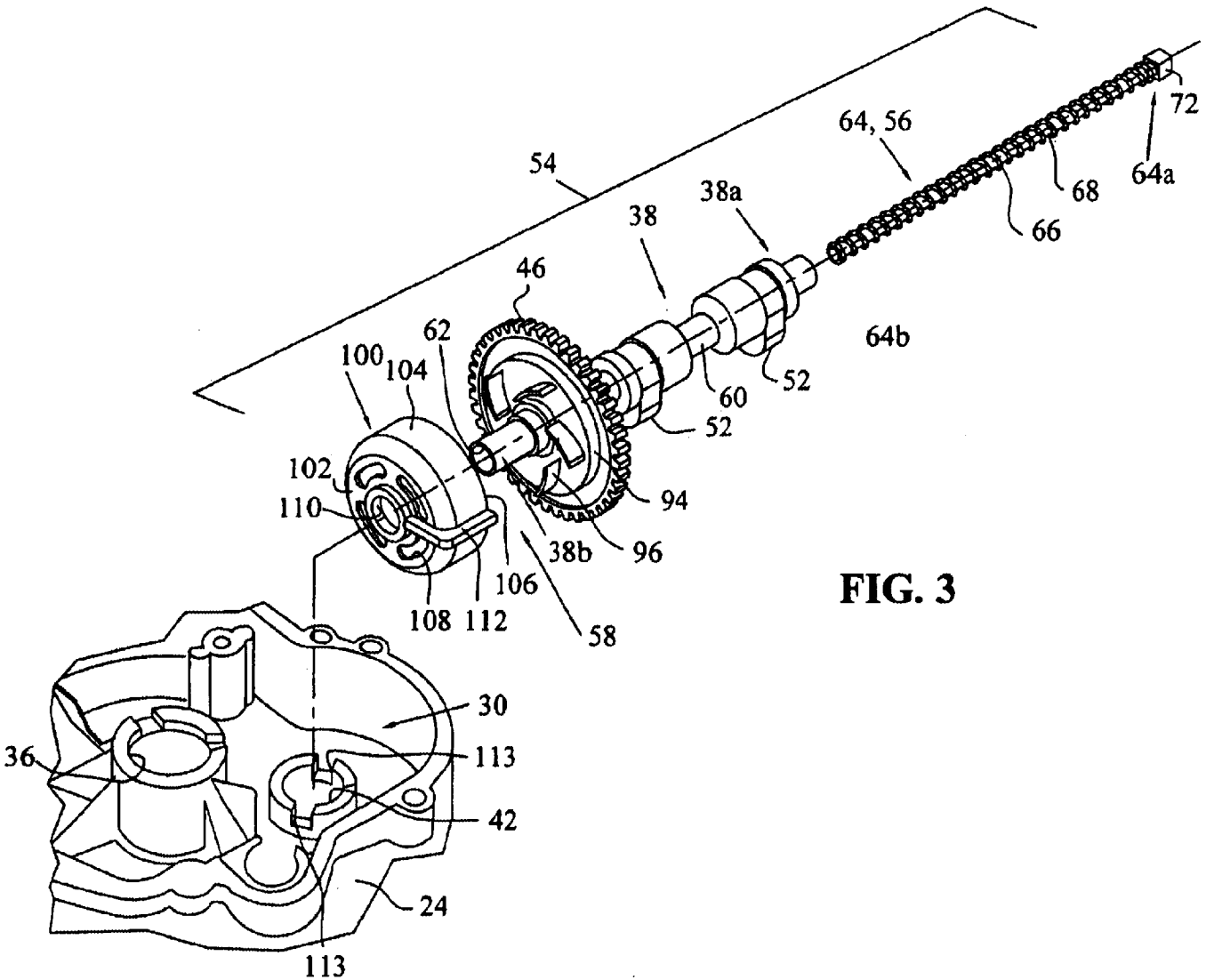
FIG. 3 is a perspective fragmentary view of a lower portion of the crankcase, and an exploded view of the various components of the lubrication assembly according to the present invention, looking upwardly along the components of the lubrication assembly.
Figure 4:
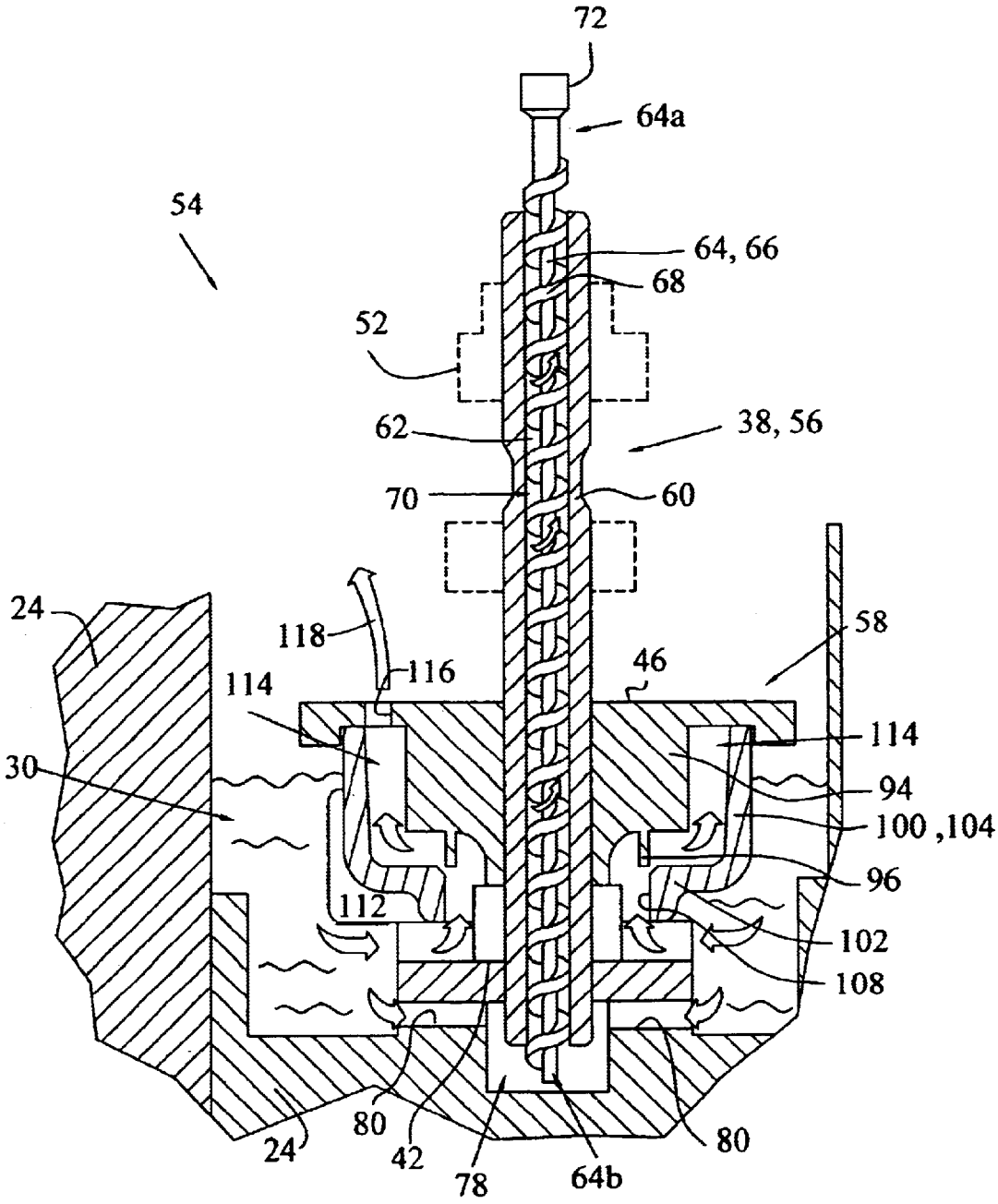
FIG. 4 is a sectional view of the lubrication assembly of the present invention, taken along line 4—4 of FIG. 1.

Referring to FIGS. 2–4, the present lubrication system will now be explained, which generally includes lubrication assembly 54 defining helical oil pump 56 and impeller oil pump 58. As shown in FIGS. 2 and 3, mounting flange 24 includes lower crankshaft bearing 36 and lower camshaft bearing 42. Oil sump 30 is carried within mounting flange 24, and includes an amount of oil therein, wherein lower crankshaft bearing 36 and lower camshaft bearing 42 are normally submerged within the oil in oil sump 30 and are lubricated thereby.

Figure 6:
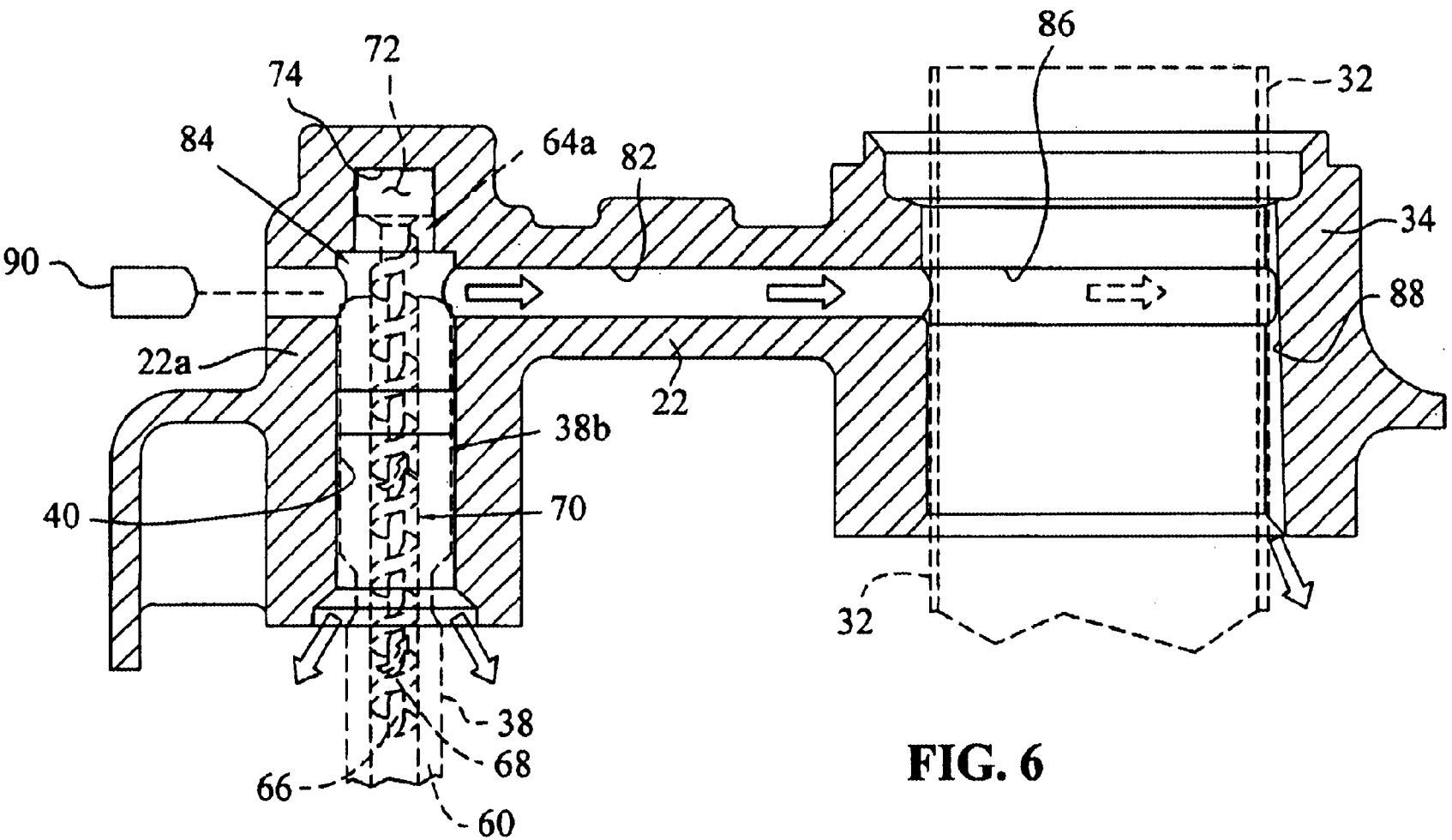
FIG. 6 is a sectional view through a portion of the upper part of the crankcase, including the upper camshaft and upper crankshaft bearings, taken along line 6—6 of FIG. 5.

Camshaft 38 includes hollow shaft portion 60 defining bore 62 therethrough which communicates upper end 38*a* and lower end 38*b* of camshaft 38. Upper end 38*a* of camshaft 38 is supported for rotation in upper camshaft bearing 40, as shown in FIG. 6, and lower end 38*b* of camshaft 38 is supported for rotation in lower camshaft bearing 42, as shown in FIG. 4. Shaft portion 60 of camshaft 38 includes exhaust lobes 52 and camshaft gear 46 mounted thereon. Shaft portion 60 of camshaft 38 may be made from a suitable metal, such as cast iron or steel, for example, and cam lobes 52 and camshaft gear 46 may be made from metal, or from a suitable plastic or resin material molded onto shaft portion 60 of camshaft 38. If made of plastic, cam lobes 52 and camshaft gear 46 may be separately molded to shaft portion 60, or alternatively, one or more of the foregoing may be formed together as a single component which is molded onto shaft portion 60.

Helical insert 64 generally includes central shaft portion 66 having helical thread 68 disposed therearound. Helical insert 64 may be made from a single piece of metal, or from a wear resistant plastic or molded resin material, for example, and is received within bore 62 of camshaft 38 in a close sliding fit to define a helical space 70 (FIGS. 4 and 6) between bore 62 and helical thread 68. Some exemplary materials from which Helical thread 68 may be made include polyamides, such as PA 66 unfilled Zytel 101 or 103; PA 66 glass filled Zytel 70 G20 (20 wt. % glass); PA 66 mineral filled Minion 10 B40 (40 wt. % mineral filled); PA 6 unfilled Zytel 7335; and PA 6 glass filled Zytel HTN 51 G35 (35 wt. % glass filled). Zytel and Minlon are registered trademarks of E.I. DuPont de Nemours Co., of Wilmington, Del.

Upper end 64*a* of helical insert 64 includes anchor portion 72 and, referring to FIG. 6, upper end 64*a* extends outwardly of upper end 38*a* of camshaft 38 with anchor portion 72 of helical insert 64 received within anchor recess 74 of upper camshaft bearing 40. As shown herein, anchor portion 72 of helical insert 64 and anchor recess 74 of upper camshaft bearing 40 include complementary square-shaped or other non-circular profiles, such that helical insert 64 may not rotate, but rather is rotatably fixed with respect to crankcase 22. The foregoing materials of helical insert 64 are resistant to wear upon frictional contact with shaft portion 60 of camshaft 38 as camshaft 38 rotates around helical insert 64, as described below.

Referring to FIG. 4, lower end 64*b* of helical insert 64 extends outwardly beyond lower end 38*b* of camshaft 38, wherein lower end 64*b* of helical insert 64 and lower end 38*b* of camshaft 38 are submerged within oil contained within chamber 78 of lower camshaft bearing 42. Oil may enter chamber 78 from oil sump 30 through passages 80.

Referring to FIG. 6, crankcase 22 includes passage 82 therethrough connecting space 84 of upper camshaft bearing 40 with upper crankshaft bearing 34. Specifically, passage 82 fluidly communicates with annular groove 86 formed in crankshaft bearing 34 around crankshaft 32, and annular groove 86 in turn fluidly communicates with axial groove 88 formed longitudinally along upper crankshaft bearing 34 parallel to crankshaft 32. Passage 82 may be formed by drilling a bore through exterior wall 22*a* of crankcase 22 through space 84 of upper camshaft bearing 40 to annular groove 86 of upper crankshaft bearing 34, followed by inserting plug 90 into wall 22*a* of crankcase 22 via a press fit or a screw-threaded engagement, for example, to close passage 82.

In operation, rotation of camshaft 38 around helical insert 64 causes oil to be drawn from chamber 78 of lower camshaft bearing 42 into camshaft bore 62, where the oil is then drawn upwardly within camshaft 38 through the helical space defined between bore 62 and helical thread 68. In this manner, the oil is forced to "climb" helical insert 64. Referring to FIG. 6, oil is drawn upwardly to upper end 38*b* of camshaft 38 and is forced under pressure into space 84 within upper camshaft bearing 40. Thereafter, a first portion of the oil within space 84 lubricates the sliding interface between upper end 38*a* of camshaft 38 and upper camshaft bearing 40, before exiting upper camshaft bearing 40 and dripping downwardly back into oil sump 30.

Another, second portion of the oil within space 84 is directed through passage 82 into annular groove 86 of upper crankshaft bearing 34 before passing through axial groove 88 and exiting upper crankshaft bearing 34 and dripping downwardly back into oil sump 30. The conveyance of oil around annular groove 86 and axial groove 88 in upper crankshaft bearing 34, as crankshaft 32 rotates within upper crankshaft bearing 34, distributes oil evenly over the sliding interface between crankshaft 32 and upper crankshaft bearing 34. In this manner, helical oil pump 56 provides pressurized oil lubrication directly to upper camshaft bearing 40 and to upper crankshaft bearing 34.

Figure 8:
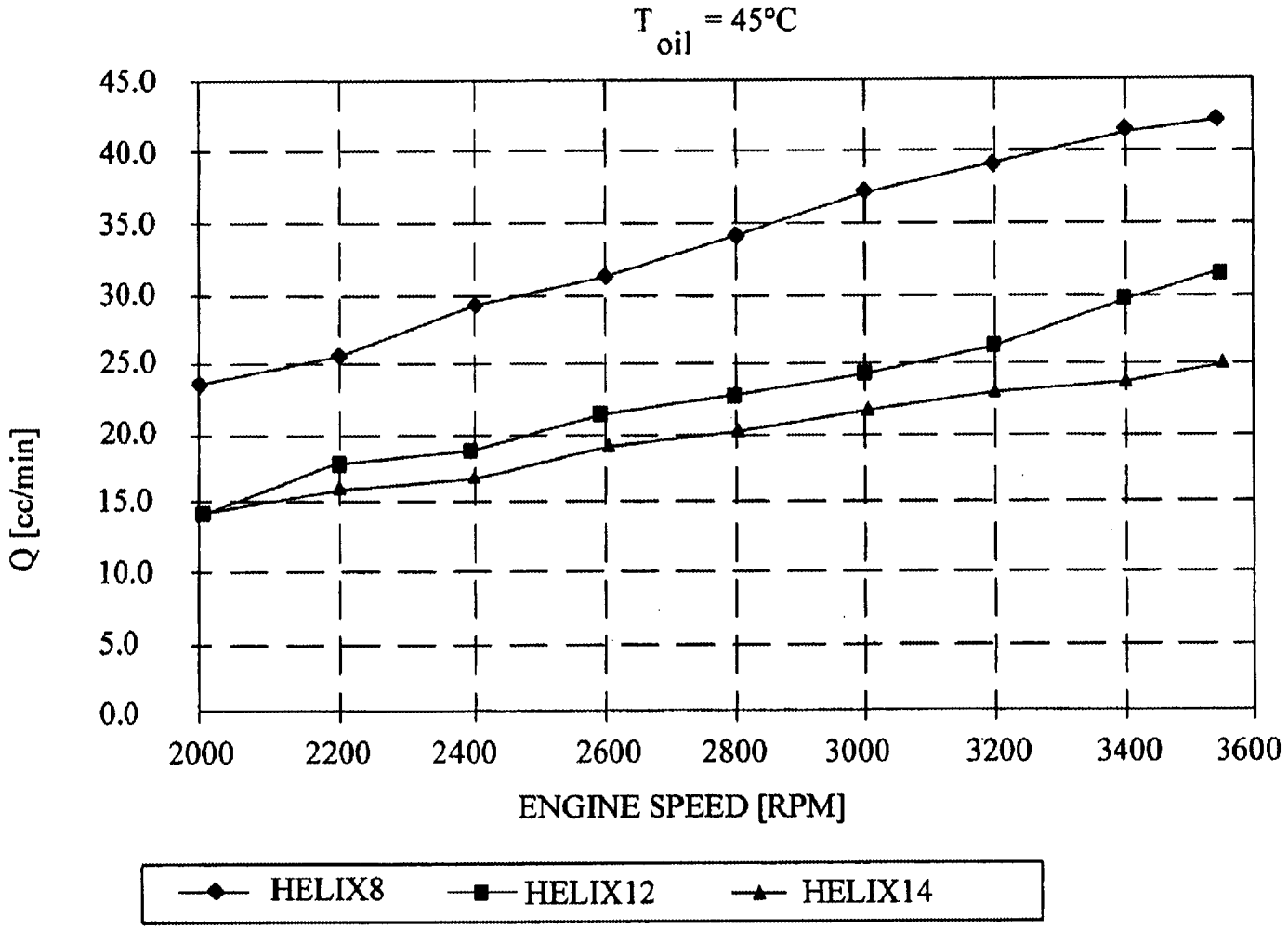
FIG. 8 is a chart showing the flow rate generated by the helical oil pump of the present lubrication assembly at varying pitches of the helical insert at an oil temperature of 45° C.
Figure 9:
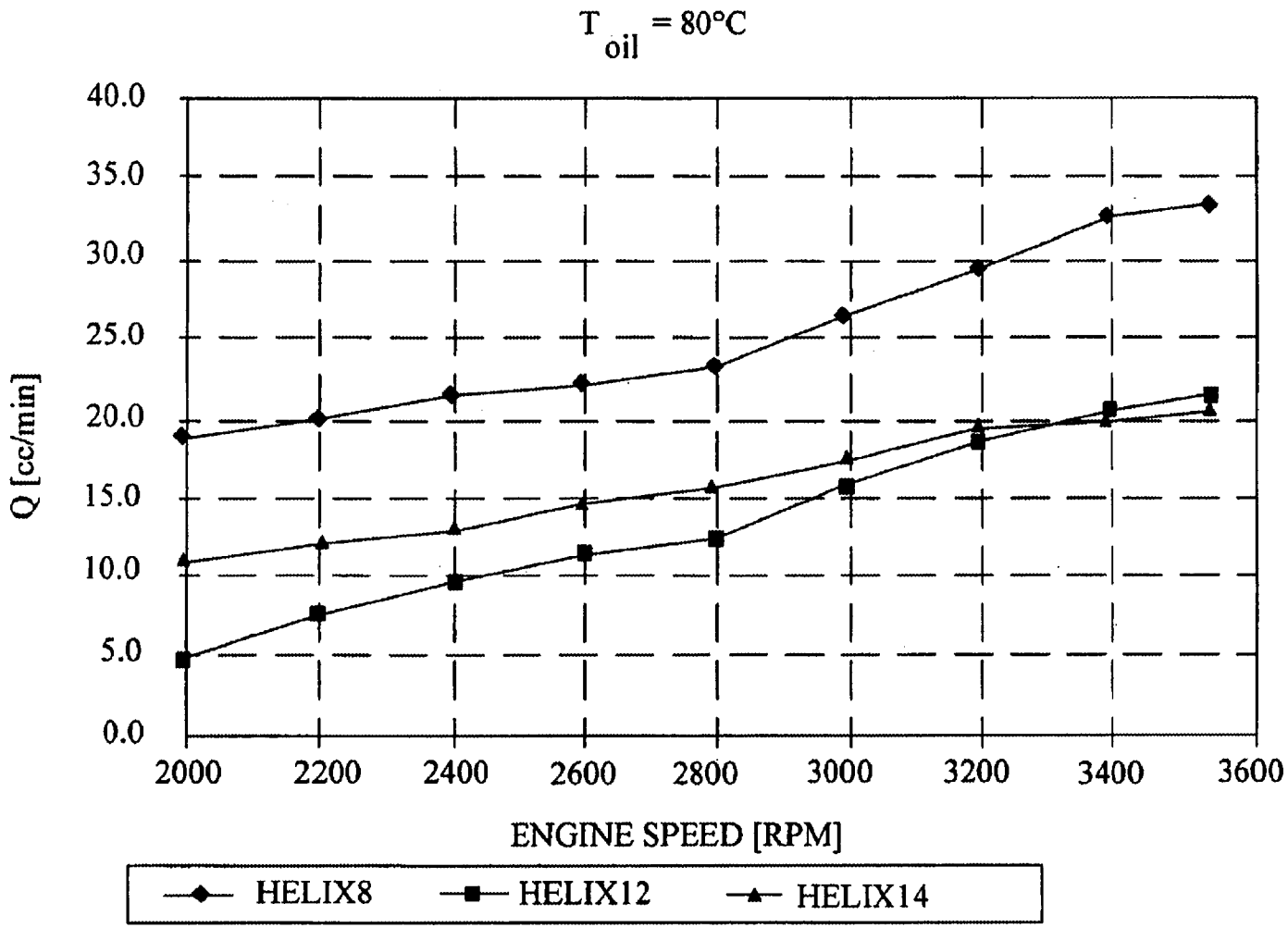
FIG. 9 is a chart showing the flow rate generated by helical oil pump of the present lubrication assembly at varying pitches of the helical insert at an oil temperature of 80° C.

In FIGS. 8 and 9, various flow rates of oil through helical oil pump 56 are shown with varying pitch of helical thread 68 of helical insert 64 at oil temperatures of 45° C. and 80° C. Generally, the oil has a greater viscosity at 45° C. than at 80° C. Referring first to FIG. 8, at an oil temperature of 45° C., which corresponds to a relatively cool engine temperature immediately after engine starting, for example, the flow rate Q (cc/min.) of oil through helical oil pump 56 is greatest when the pitch of helical insert 64 is 8 millimeters (mm) throughout engine speeds ranging from 2000 rpm to 3600 rpm. The pitch of helical insert 64 is expressed herein in millimeters (mm) as the distance between adjacent threads. Further, at 45° C., the flow rate for pitch 12 mm is greater than that for pitch 4 mm throughout the speed range of 2000 rpm to 3600 rpm.

Referring to FIG. 9, at an oil temperature of 80° C. which corresponds to an engine running temperature, the flow rate Q (cc/min.) of oil through helical oil pump 56 remains greatest when the pitch of helical insert 64 is 8 mm throughout engine speeds ranging from 2000 rpm to 3600 rpm. At 80° C., the flow rate for pitch 4 mm is greater than that for pitch 12 mm until the engine speed reaches approximately 3300 rpm, wherein at higher engine speeds, the flow rate for pitch 12 mm is greater than that for pitch 4 mm. From FIGS. 8 and 9, it may be seen that helical oil pump 56 is somewhat more effective in pumping oil when the oil has a relatively greater viscosity at a low oil temperature than when the oil has a relatively lesser viscosity at higher oil temperatures.

Referring to FIGS. 2–4, details of impeller oil pump 58 will now be explained. Referring first to FIG. 3, camshaft 38 includes collar 94 having a plurality of impeller blades 96 projecting therefrom. Collar 94 may be made from a suitable plastic or resin material molded onto camshaft 38. Further, collar 94 may comprise a separate component mounted to camshaft 38, or alternatively, may be integrally formed with camshaft gear 46. Although impeller oil pump 58 is described below as an impeller-type pump, oil pump 58 may also be configured, with minor modifications to the components of oil pump 58, as a gerotor-type pump, a plunger pump, or another suitable pump.

As shown in FIGS. 2 and 3, pump body 100 is a generally cup-shaped component made from metal or a suitable rigid plastic material, for example. Pump body 100 generally includes base wall 102, and annular side wall 104 extending from base wall 102 and terminating in outer rim 106. Base wall 102 includes a plurality of oil inlet slots 108 disposed around camshaft opening 110 through which camshaft 38 extends. As shown in FIG. 4, at least a portion of pump body 100 is normally submerged within the oil in oil sump 30, such that oil may enter pump body 100 through oil inlet slots 108. Locating flange 112 of pump body 100 projects from base wall 102 and/or side wall 104, and fits within grooves 112 of lower camshaft bearing 42, as shown in FIG. 2, to locate pump body 100 with respect to lower camshaft bearing 42, and also to fix pump body 100 against rotation with respect to mounting flange 24.

Referring to FIG. 4, camshaft 38 is inserted through camshaft opening 110 (FIG. 3) in base wall 102 of pump body 100 such that collar 94 and impeller blades 96 are received within pump body 100. Washer 115 is disposed between collar 94 and pump body 100. Camshaft gear 46 abuts outer rim 106 of pump body 100 in a sliding bearing contact, such that camshaft gear 46 closes pump body 100 to define pump chamber 114 between pump body 100 and camshaft gear 46, and wherein camshaft gear 46 is rotatable with camshaft 38 while pump body 100 is rotatably fixed with respect to mounting flange 24 and does not rotate.

Figure 7:
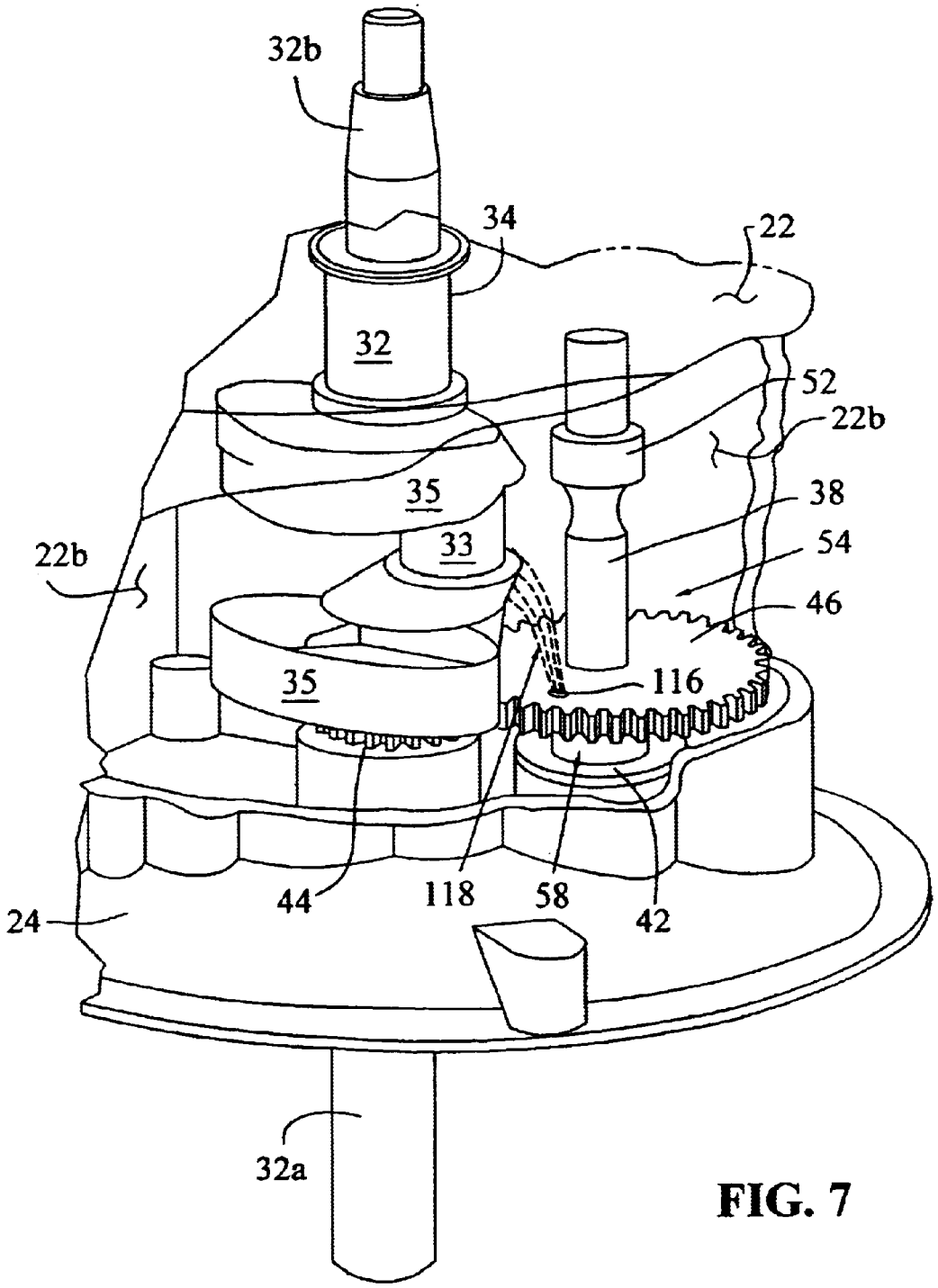
FIG. 7 is a cutaway perspective view of a portion of the crankcase of the engine of FIG. 1, showing a stream of pressurized oil directed from the impeller pump of the lubrication assembly to a plurality of locations within the crankcase as the cam gear rotates.

In operation, camshaft gear 46 is rotatably driven by crankshaft 32 of engine 20 through drive gear 44, and rotates camshaft 38. Rotation of camshaft 38 rotates impeller blades 96 within pump body 100, thereby drawing oil from oil sump 30 through inlet slots 108 of pump body 100 into pump chamber 114. Oil is forced outwardly of pump chamber 114 through hole 116 in camshaft gear 46. Due to the relatively small size of hole 116 in camshaft gear 46 in proportion to the relatively larger size of inlet slots 108 in pump body 100, oil is pressurized within pump chamber 114. Thus, oil is forced outwardly of pump chamber 114 through hole 116 in camshaft gear 46 in the form of a pressurized oil stream 118 which, as shown in FIG. 7, rotates with opening 116 in camshaft gear 46 as camshaft gear 46 rotates. In this manner, pressurized oil stream 118 is directed to a plurality of locations within crankcase 22 as camshaft gear 46 rotates, such as crank pin 33, throws 35, and the inner walls **22*b* of crankcase 22**.

Oil contacting the inner walls **22*b* of crankcase 22 absorbs heat from crankcase 22 which is generated during running of engine 20, and the oil then drips downwardly back into oil sump 30 to disperse the heat within oil sump 30. Advantageously, impeller oil pump 58 circulates a relatively large amount of oil continuously within crankcase 22 and, due to the spray contact of oil within pressurized oil stream 118 with inner walls 22*b* of crankcase 22, crankcase 22 is cooled to reduce the overall operating temperature of engine 20. For example, it has been found that the oil distribution and circulation action of impeller oil pump 58 decreases the temperature of the oil within engine 20 about 20° C. from the normal temperature of the oil within engine 20 when engine 20** is at running speeds.

Although a single opening 116 has been shown within camshaft gear 46 in the form of a hole in FIGS. 2 and 7, camshaft gear 46 may include multiple openings therein for directing oil streams to various selected points of contact within crankcase 22 to lubricate certain components within crankcase 22 and/or to cool crankcase 22. Additionally, the size, shape, and directional orientation of such openings may be varied as desired to direct one or more pressurized oil streams in desired directions within crankcase 22. Further, camshaft gear 46 may include a tube or other suitable structure having an opening or passageway therein, which is molded or inserted within camshaft gear 46 and through which pressurized oil stream 118 is directed.

The engagement between drive gear 44 and camshaft gear 46 may be timed with respect to the location of openings 116 in camshaft gear 46, such that the direction and spray of pressurized oil stream 118 is selectively determined based upon the location of other moving components with crankcase relative to opening 116 in camshaft gear 46. For example, drive gear 44 and camshaft gear 46 may be timed such that opening 116 is disposed directly beneath crank pin 33 once every rotation of camshaft gear 46, so that pressurized oil stream 118 directly contacts crank pin 33 to lubricate the connection point between crank pin 33 and the connecting rod (not shown) during every rotation of camshaft gear 46. Also, drive gear 44 and camshaft gear 46 may be timed such that opening 116 is disposed directly beneath throws 35 of camshaft 32 once every rotation of camshaft gear 46, such that pressurized oil steam 118 is directed directly against throws 35 and is thereby deflected in multiple directions within crankcase 22.

In this manner, helical oil pump 56 and impeller oil pump 58 cooperate to lubricate the moving parts of engine 20. Specifically, helical oil pump 56 provides a supply of pressurized lubricating oil directly to upper camshaft bearing 40 and upper crankshaft bearing 34 to lubricate same, and impeller oil pump 58 directs one or more streams 118 of pressurized oil to selected locations within crankcase 22 to lubricate the moving parts within crankcase 22 with pressurized oil. Additionally, the streams 118 of pressurized oil from oil pump 58 contact the interior walls **22*a* of crankcase 22 and absorb heat therefrom before dripping back into oil sump 30 and, due to the relatively large amount of oil which is continuously circulated within crankcase 22 by impeller oil pump 58**, an engine cooling effect is provided.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a crankcase containing an oil sump therein;

a crankshaft rotatably supported within said crankcase;

a second shaft rotatably supported within said crankcase in timed driven relationship with said crankshaft, said second shaft disposed vertically and including a bore therethrough which communicates between upper and lower ends of said second shaft; and a helical insert disposed within said bore, said helical insert rotationally fixed with respect to said crankcase, said lower end of said second shaft and said helical insert in communication with said oil sump wherein rotation of said second shaft about said helical insert draws oil from said oil sump upwardly through said bore.

2. The internal combustion engine of claim 1, wherein said helical insert includes an upper end portion extending outwardly of said upper end of said second shaft, said upper end portion of said helical insert rotationally fixed with respect to said crankcase.

3. The internal combustion engine of claim 1, wherein said helical insert includes a lower end portion disposed proximate said lower end of said second shaft, said lower end portion of said helical insert and said lower end of said second shaft submerged within oil of said oil sump.

4. The internal combustion engine of claim 1, wherein said helical insert comprises a central shaft having a helical thread therearound.

5. The internal combustion engine of claim 1, wherein said upper end of said second shaft is rotatably supported in an upper second shaft bearing, and said oil drawn upwardly through said bore of said second shaft is carried to said upper second shaft bearing to lubricate same.

6. The internal combustion engine of claim 5, wherein said crankshaft is disposed vertically, and includes an upper end rotatably supported in an upper crankshaft bearing, said crankcase including a passage communicating said upper second shaft bearing with said upper crankshaft bearing, wherein oil from said upper second shaft bearing is carried through said passage to said upper crankshaft bearing to lubricate same.

7. The internal combustion engine of claim 6, wherein said upper crankshaft bearing includes an annular groove therearound in communication with said passage, and an axial groove in communication with said annular groove, said annular and axial grooves distributing oil around said crankshaft upper end as said crankshaft rotates.

8. The internal combustion engine of claim 1, wherein said second shaft is a camshaft including at least one cam lobe thereon.

9. The internal combustion engine of claim 8, wherein said crankshaft drives said camshaft through a gear set, comprising;

a drive gear mounted on said crankshaft; and a cam gear mounted on said camshaft; said drive gear engaging said cam gear.

10. An internal combustion engine, comprising:

a crankcase containing an oil sump therein;

a shaft rotatably supported within said crankcase;

a plate mounted on said shaft and rotatable therewith, said plate having at least one opening therethrough;

a pump body fixed with respect to said crankcase and in fluid communication with said oil sump, said pump body and said plate defining a pump chamber therebetween; and a pump assembly disposed within said pump chamber and mounted on said shaft for rotation therewith;

whereby rotation of said shaft and said pump assembly draws oil from said oil sump into said pump chamber and forces oil outwardly of said pump chamber through said opening in said plate.

11. The internal combustion engine of claim 10, wherein said pump assembly forces oil through said opening in said plate in the form of a pressurized oil stream which is directed toward different locations within said crankcase as said plate rotates.

12. The internal combustion engine of claim 10, wherein said plate comprises a gear mounted on said shaft and rotatable therewith, said gear having at least one opening therethrough.

13. The internal combustion engine of claim 12, wherein said shaft is a camshaft, said camshaft driven in timed relation by a crankshaft rotatably supported within said crankcase through a drive gear on said crankshaft which drives said gear.

14. The internal combustion engine of claim 10, wherein said pump body comprises a cup-shaped component having a rim portion in bearing contact with said plate.

15. The internal combustion engine of claim 10, wherein said pump body includes at least one inlet opening submerged within said oil sump.

16. The internal combustion engine of claim 10, wherein said plate and said pump assembly are integrally formed.

17. The internal combustion engine of claim 10, wherein said shaft includes an end extending through said pump body, said shaft end supported in a bearing carried by said crankcase.

18. The internal combustion engine of claim 10, wherein said pump assembly comprises a plurality of impeller blades.

19. An internal combustion engine, comprising:

a crankcase containing an oil sump therein;

a shaft rotatably supported within said crankcase, said shaft including a bore therethrough which communicates between upper and lower ends of said shaft;

a helical insert disposed within said bore, said helical insert rotationally fixed with respect to said crankcase, said lower end of said second shaft and said helical insert in communication with said oil sump;

a plate mounted on said shaft and rotatable therewith, said plate having at least one opening therethrough;

a pump body fixed with respect to said crankcase and in fluid communication with said oil sump, said pump body and said plate defining a pump chamber therebetween; and an pump assembly disposed within said pump chamber and mounted on said shaft for rotation therewith;

whereby rotation of said shaft and said impeller assembly about said helical insert draws oil from said oil sump upwardly through said bore, and draws oil from said oil sump into said pump chamber and forces oil outwardly of said pump chamber through said opening in said plate.

20. A method of cooling an internal combustion engine, comprising the steps of:

rotating a shaft within the engine crankcase which includes a plate and an impeller mounted thereon, the impeller disposed within a pump housing at least partially defined by the plate;

drawing oil from an oil sump within the engine crankcase into the pump housing through an inlet opening submerged within the oil sump;

pressurizing the oil within the pump housing;

directing the oil outwardly of the pump housing through at least one opening in the plate, in the form of a pressurized oil stream which rotates with the plate to contact a plurality of locations within the crankcase;

transferring heat from the crankcase to the oil upon contact of the stream with the plurality of locations within the crankcase; and allowing the oil to drain from the plurality of locations within the crankcase into the oil sump.

* * * * *